United States Patent [19]

Carter

[11] Patent Number: 5,048,590

[45] Date of Patent: Sep. 17, 1991

[54] METHOD AND APPARATUS FOR FORMING BATTERY TERMINAL BUSHINGS

[75] Inventor: Warren E. Carter, Murfreesboro, Tenn.

[73] Assignee: Molded Metal Services, Inc., Murfreesboro, Tenn.

[21] Appl. No.: 565,760

[22] Filed: Aug. 1, 1990

[51] Int. Cl.[5] ..... B22D 27/11

[52] U.S. Cl. ..... 164/120; 164/320

[58] Field of Search ..... 164/120, 319, 320, 302; 72/327, 328, 354, 2, 355.4

[56] References Cited

U.S. PATENT DOCUMENTS 4,776,197 10/1988 Scott ..... 72/358

4,779,665 10/1988 Ouimet ..... 164/320

*Primary Examiner*—Kuang Y. Lin

*Attorney, Agent, or Firm*—Harrington A. Lackey

[57] ABSTRACT

A method and an apparatus for forming a battery terminal bushing from a molten lead alloy in order to substantially eliminate the porosity in the material of the finished bushing. This method and apparatus includes the heating of the lead alloy until molten, pouring the molten alloy into a mold cavity, forcing a punch centrally and longitudinally through the center of the mold cavity not only to remove the core from the center of the material which will form the bushing, but also to simultaneously force the remaining alloy within the mold cavity campactly against the inner surface of the mold cavity, withdrawing the punch and ejecting the finished bushing of high density and a polished exterior surface, substantially free of air pores within the bushing material.

16 Claims, 3 Drawing Sheets

METHOD AND APPARATUS FOR FORMING BATTERY TERMINAL BUSHINGS

BACKGROUND OF THE INVENTION

This invention relates to a method and apparatus for forming a battery terminal bushing, and more particularly to an apparatus and method for forming a battery terminal bushing in which the porosity in the bushing has been substantially eliminated.

All conventional battery terminal bushings known to the Applicant are produced by die casting. Die cast battery terminal bushings are well known for the high degree of porosity within the cast material. It is virtually impossible to obtain a 100% porosity free bushing using the process of die casting. In die casting, molten metal is introduced into a mold cavity through a small opening or sprue, under high pressure. The high pressure causes a turbulence of the molten metal within the mold cavity. The molten metal is accordingly mixed with air, and when the metal solidifies, the air or gasses are trapped within the cast part.

Porosity in the cast material of a battery terminal bushing creates several problems. In a completed battery having a die cast terminal bushing, the sulfuric acid electrolyte within the battery casing tends to leak or creep through the pores of the bushing to the outside of the battery. The creepage of the electrolyte reduces the amount of electrolyte remaining in the battery cells. Moreover, the electrolyte which has creeped to the exterior of the terminals causes the terminals to corrode and thereby impairs the conductivity of the terminal connections. Moreover, the acid electrolyte exposed outside the battery is hazardous to the skin, clothing and other materials which contact the electrolyte.

The highly porous die cast terminal bushings conventionally used also permit the transmission of gas from the batteries while the battery is being charged. The electrolyte gasses are very explosive, and a faulty weld between the porous bushing and the element post can produce an electrical arc which would ignite the leaking gas.

Moreover, during the life of an electrolytic battery having die cast terminal bushings, both the liquid electrolyte creepage and the gaseous electrolyte leakage tend to increase over the life of the battery. The battery is subject to ordinary wear and tear, principally caused by vibration from the vehicle in which it is installed. Additionally, during the life of the battery, the plates tend to grow, that is they expand and, via the terminal conductive straps and element posts, can stress the element post/bushing weld. In the course of shipping and installation, the battery typically is subjected to rough treatment and mishandling as well as dropping or overtightening the terminal connections. Consequently, the various seals in the battery deteriorate and become more susceptible to leaking.

The industry attempts to combat the electrolyte creepage and gas leakage problems of the porous die cast terminal bushings by improving the sealing between the battery terminal bushings, element posts, and the openings in the casing through which the post and bushings protrude. However, such attempts have not entirely overcome the problems of electrolyte liquid and gas leakage.

Examples of some attempts to overcome the problems involved in connecting and sealing battery terminal posts and bushings with battery casings are disclosed in the following U.S. patents:

| | | |
|---|---|---|
| 3,113,892 | Albrecht | Dec. 10, 1963 |
| 3,522,105 | Sabatino | July 28, 1970 |
| 3,767,467 | Miller et al | Oct. 23, 1973 |
| 4,143,215 | Mocas | Mar. 6, 1979 |
| 4,317,871 | Wolf et al | Mar. 2, 1982 |
| 4,645,725 | Kump et al | Feb. 24, 1987 |

In all of the above patents, the battery terminal bushings are made in accordance with the conventional method of die casting.

One form of producing an electrical battery pole or bushing by a method other than die casting, is disclosed in the U.S. Scott U.S. Pat. No. 4,776,197, issued Oct. 11, 1988. In the Scott patent, a cold billet or cylinder of lead alloy is forced under pressure into a die in order to form the completed pole or terminal, and both opposite ends are sheared off to complete the trimming process. However, throughout the description of the process in the Scott patent, it is emphasized that the metal is not heated, and therefore never becomes molten, and in fact, the absence of heating the metal is considered an advantage in the Scott process.

SUMMARY OF THE INVENTION

It is therefore an object of this invention to produce a battery terminal bushing which is substantially nonporous by a method which does not involve die casting.

Another object of this invention is to provide a method and apparatus for forming a nonporous battery terminal bushing by the steps of pouring a hot molten lead alloy into a mold cavity and then forcing a punch down through the center of the molten metal to extract the central core of material and simultaneously compact the remaining metal and eliminate the air pockets within the metal bushing. After the central core of material is completely removed from the mold cavity, the punch is withdrawn and the finished bushing extracted from the mold cavity.

The apparatus for forming the nonporous battery terminal opposed mold halves capable of being moved between a closed position and an open position and having open top and bottom ends to permit the complete passage of the punch through the height of the mold cavity.

The apparatus made in accordance with this invention also contemplates an automatic means of severing the unwanted metal material, including the punched core from the metal remaining in the mold cavity which forms the completed bushing.

The apparatus made in accordance with this invention also contemplates a bushing extracting device including an extractor member forming an annular bottom wall for the mold cavity which is forced upward after the punching operation in order to extract the completed bushing from the mold cavity.

DESCRIPTION OF THE PREFERRED EMBODIMENTS

Figure 1:
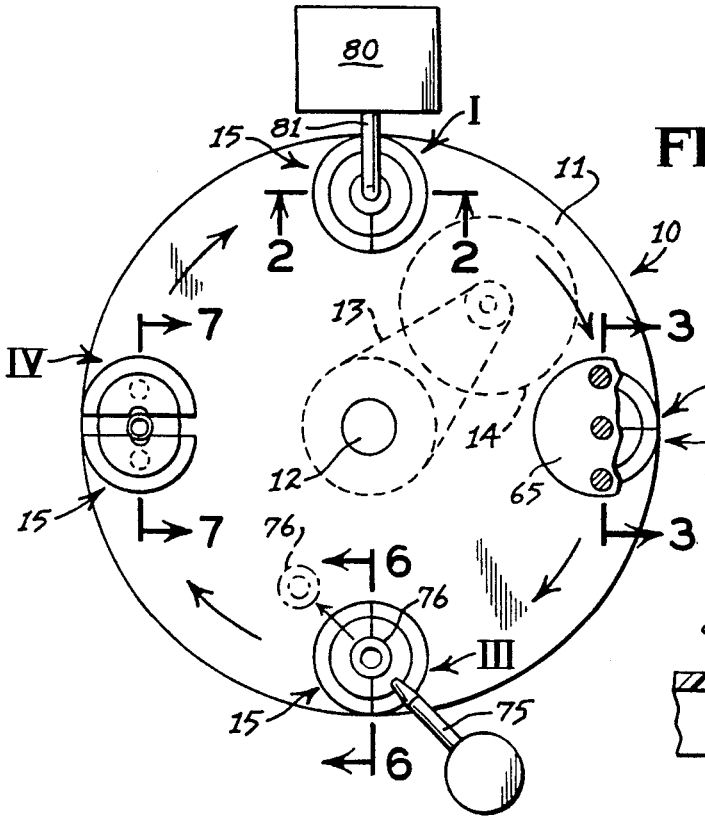
FIG. 1 is a schematic top plan view of the apparatus made in accordance with this invention including a turntable for indexing the work to successive stations for producing a nonporous battery bushing in accordance with this invention.

Referring now to the drawings in more detail, FIG. 1 discloses schematically one form of the apparatus 10 which could be used in carrying out the method of making substantially nonporous battery terminal bushings 25 in accordance with this invention. The apparatus 10, which is schematically shown in FIG. 1 may include a turret 11 mounted on the vertical spindle or shaft 12, which may be driven through a reduction transmission 13 by motor 14 for indexing the turret 11 through several stations for carrying out the process in accordance with this invention. As illustrated in FIG. 1, the turret 11 may be indexed through four separate stations. Station I is the pouring station. Station II is the punching station. Station III is the trim station, while station IV is the ejection station.

Figure 2:
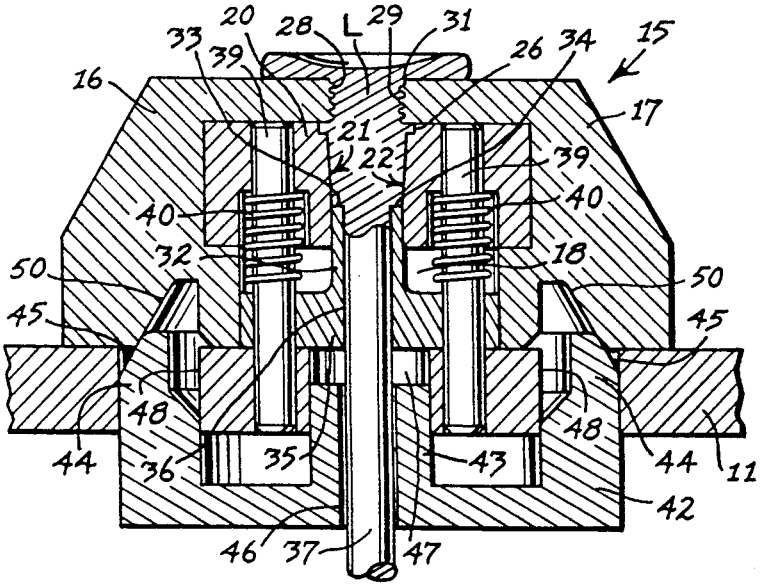
FIG. 2 is an enlarged fragmentary section taken along the line 2—2 of FIG. 1, illustrating the pouring step at the first station I of the apparatus.

As best disclosed in FIGS. 1 and 2, in the initial pouring station I, a die assembly 15 is mounted upon the turntable or turret table 11.

The die assembly 15 includes a pair of opposed die members 16 and 17 which are supported on the top surface of the turntable 11 for transverse reciprocable movement toward and away from each other, and are shown in their closed position in FIG. 2. Within the closed die members 16 and 17 is a hollow chamber 18 in which is received a lower integral die or mold 20. The mold 20 includes a mold cavity 21 extending vertically through the center of the mold 20. The mold cavity 21 has upward flared side wall surfaces 20 which correspond with or define the exterior surface of the lower or shank portion 23 of the completed battery terminal bushing 25 disclosed in FIG. 9. The upper portion of the mold cavity 21 defines an outwardly projecting recess or recessed surface 26 extending radially outward from the tapered wall surface 22 to define and form the annular flange 27 on the completed bushing 25 (FIG. 9).

Figure 9:
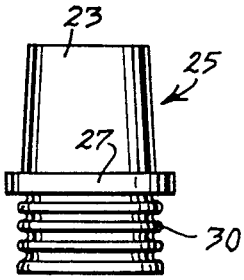
FIG. 9 is an enlarged side elevational view of the completed battery terminal bushing.

The upper portion of the die members 16 and 17 define inwardly projecting and opposed threaded jaw halves 28 and 29 which define or have the same configuration as the lower threaded portion 30 of the bushing 25 disclosed in FIG. 9. The upper end portions of the opposed threaded jaws 28 and 29 define the top open end 31 of the mold cavity 21.

Also received within the inner chamber 18 is a tubular ejector member 32 projecting upward into the lower end of the mold cavity 21 and terminating in an upward facing annular ledge 33. The ledge 33 defines a floor or annular bottom wall for the mold cavity 21. The opening formed by the circular hole confined by the annular ledge 33 defines the effective bottom open end 34 of the mold cavity 21. The lower end of the tubular ejector member 32 is provided with an enlarged ejector base 35 having a central vertical uniform opening 36 therethrough for receiving downwardly thrust metal material, such as the slug or plug 37.

The integral lower mold 20 and the ejector base 35 are maintained in alignment by the vertical guide pins 39 and coil springs 40. The bottom of the ejector base 35 also normally rests upon the top surface of the turntable 11, as illustrated in FIG. 2.

Also mounted for vertical, reciprocable movement within the table 11 below the die assembly 15 is an ejector actuator member 42 having an upward projecting central ejector boss 43 and an upward projecting concentric annular die actuator 44, having an upwardly converging annular cam surface 45. A vertical cylindrical hole 46 extends centrally through the ejector boss 43 for receiving the excess plug or core material 37. The ejector boss 43 and the die actuator 44 are adapted to vertically reciprocate through corresponding openings 47 and 48 within the turntable 11.

An annular downward opening cam recess 50 formed concentrically in the die member halves 16 and 17 are shaped to cooperate with the cam surfaces 45 on the die actuators 44.

Figure 3:
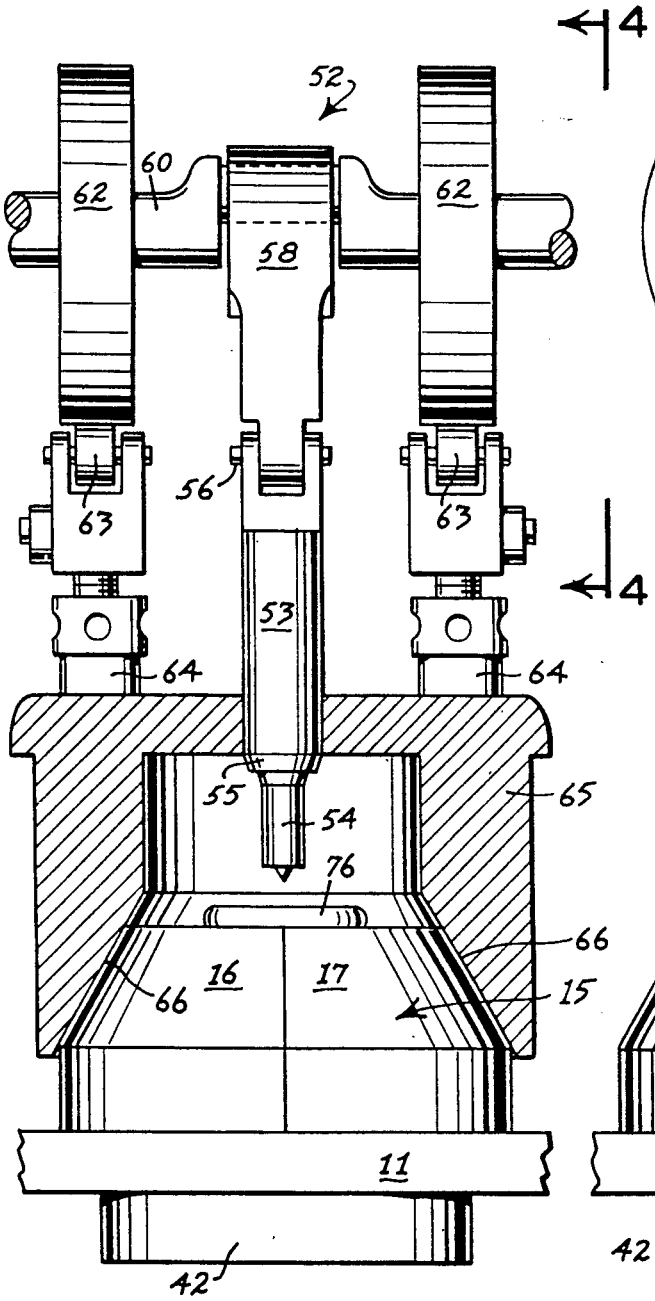
FIG. 3 is an enlarged fragmentary section taken along the line 3—3 of FIG. 1, illustrating the punching and clamping apparatus in station II.
Figure 4:
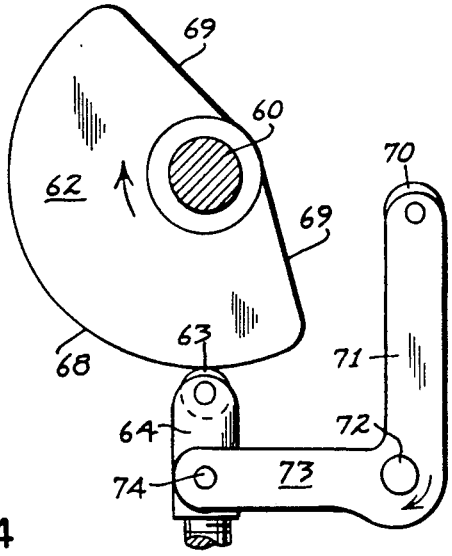
FIG. 4 is a fragmentary side elevational view taken along the line 4—4 of FIG. 3, illustrating the positive lowering and raising of the die clamping apparatus.
Figure 5:
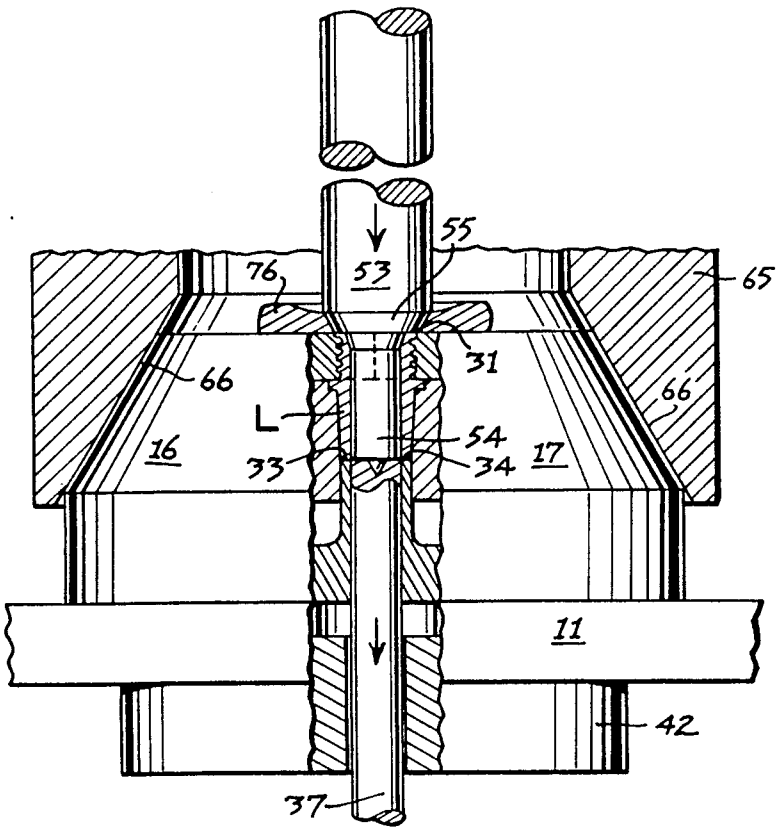
FIG. 5 is an enlarged fragmentary sectional elevation, similar to FIG. 3, with portions broken away, illustrating the punch in its lower-most position in station II.

When the die assembly 15 is indexed from station I to station II in FIG. 1, the die assembly 15 moves beneath a punch and clamp assembly 52, as best illustrated in FIG. 3. The punch and clamp assembly 52 includes a vertically reciprocable punch member 53 the lower end of which forms a substantially cylindrical punch 54, the upper end portion of which flares outwardly into a shoulder 55. The punch member 53 is journalled by pin 56 to an eccentric or crank mechanism 58 eccentrically mounted on a continuously driven rotary shaft 60, which is driven by any convenient drive mechanism, not shown. The continuous rotation of the driven shaft 60 actuates the eccentric crank mechanism 58 in order to vertically reciprocate the punch 54 from its uppermost position disclosed in FIG. 3, to its lowermost position disclosed in FIG. 5. The punch 54 is coaxially aligned with the vertical axis of the mold cavity 21, as illustrated in FIG. 5.

Also supported on opposite sides of the crank mechanism 58 are a pair of large cam members 62, the surfaces 68 and 69 of which engage the cam follower rollers 63 and 70 on the vertically reciprocable clamp posts 64 supporting an annular clamp member 65. The lower ends or jaws of the clamp member 65 are chamferred to define downward and outwardly flared cam surfaces 66. Lower cam roller 63 is mounted on top of each clamp post 64. Each cam roller 70 is mounted on top of the upper arm of bell-crank 71 journalled about a fixed pivot pin 72 The lower lateral arm 73 of the bell-crank 71 is pivotally connected by pin 74 to the clamp post 64 below the cam roller 63.

The timing of the cams 62 and the crank mechanism 58 are such that the cam members 62 are forced down with the clamp posts 64 causing the clamp member 65 to move downwardly so that its clamp surfaces 66 engage and force inwardly the outer cam surfaces of the die members 16 and 17. As long as the clamp member 65 is in its lowermost position, the die members 16 and 17 will be maintained or locked in their closed position, as illustrated in FIGS. 3 and 5.

Then, after the die members 16 and 17 are clamped in their closed position, the crank mechanism 58 will cause the ram or punch 54 to descend coaxially into the die cavity 21. As illustrated in FIG. 5, the punch 54 will descend entirely through the full height, and possibly even lower, in the mold cavity 21. The punch 54 will descend at least through the bottom open end 34 of the mold cavity 21.

Figure 6:
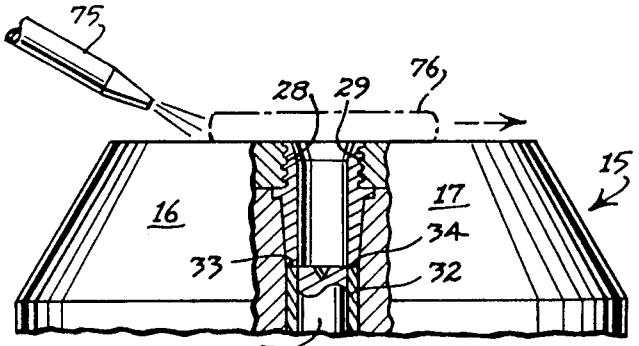
FIG. 6 is an enlarged fragmentary elevational view, taken along the line 6—6 of FIG. 1, of the mold at station III, in which the excess mold material is trimmed.

When the die assembly 15 is indexed on its turntable 11 from station II to the trim station III, an air jet 75 may be activated to blow off the excess metal material 76 which has been severed from the material remaining in the mold cavity 21, as illustrated in FIG. 6.

Figure 7:
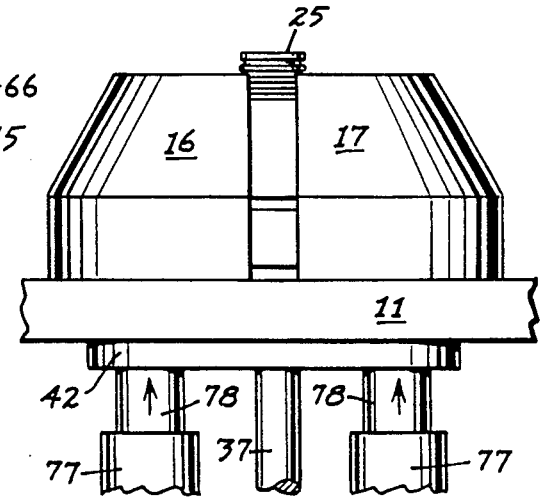
FIG. 7 is an enlarged fragmentary elevational view, taken along the line 7—7 of FIG. 1, of the mold in its ejection position at station IV.
Figure 8:
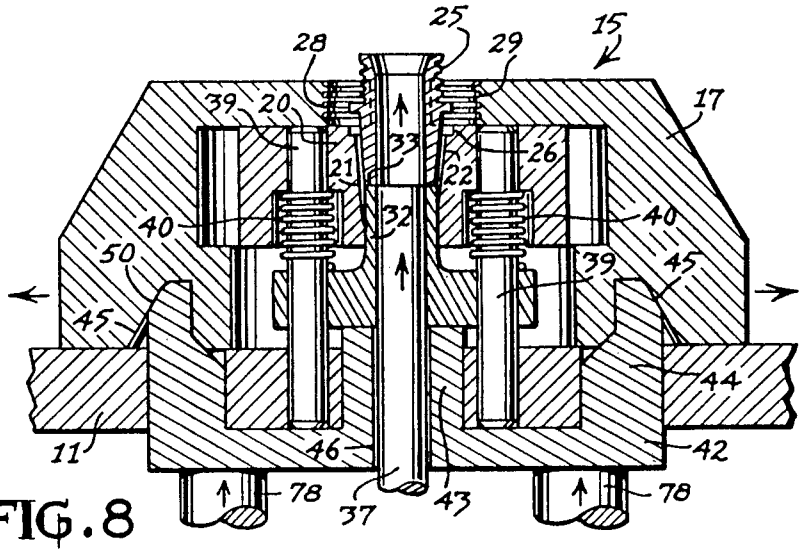
FIG. 8 is an enlarged fragmentary sectional elevation of the mold disclosed in FIG. 7 in the ejection station IV.

When the die assembly 15 is moved by the indexing of the turntable II from station III to the ejector station IV, a pair of ejector cylinders 77 (FIG. 7) project upward a corresponding pair of ejector pistons 78 forcing upward the actuator member 42 to simultaneously cause the ejector boss 43 to force upward the tubular ejector member 32 and to cause the die actuator 44 to move upwardly and cam outwardly the die members 16 and 17, as best illustrated in FIGS. 7 and 8. As the die members 16 and 17 are forced outwardly, the upper threaded jaws 28 and 29 move away from each other to free the completed bushing 25 for upward extraction or ejection by the ejector member 32.

In the operation of the apparatus 10 in order to carry out the process of producing a porosity free battery terminal bushing, a lead alloy is introduced into a melt pot 80 (FIG. 1) where it is heated to a molten condition of approximately 600 deg. F. The molten lead alloy is discharged from the melt pot 80 through a gravity metering conduit 81 into the upper open end of the die assembly 15.

The lead alloy used in the process may have the following values:

| ELEMENT | ACTUAL PERCENTAGE BY WEIGHT | RANGE PERCENTAGE BY WEIGHT |
|---|---|---|
| Antimony | 3.00% | 2.90–3.20% |
| Tin | 0.25% | 0.25–0.45% |
| Arsenic | 0.18% | 0.15–0.30% |
| Lead and immaterial trace elements | balance | balance |

As is well known, in other lead alloys, the antimony and arsenic are used to give rigidity to the lead when it solidifies.

The tin facilitates release of the finished product from the mold and also gives the finished product a better and lustrous appearance.

Before the molten lead is poured into the die assembly 15, the elements of the die assembly 15 are in their respective positions disclosed in FIG. 2. The die members 16 and 17 are pulled together in their closed position as disclosed, and the ejector actuator member 42 is in its lower inoperative position as disclosed in FIG. 2.

After the lead alloy L is poured into the die assembly 15 and the alloy moves downwardly between the threaded die jaws 28 and 29, the integral mold cavity 21 and the central hole 36, and thence downward through the hole 46 in the ejector boss 43 to form the lead plug 37. The molten lead L usually solidifies in the hole 36 sufficiently to prevent any further passage or discharge of the lead L through the hole 36.

Controls, not shown, either actuated manually, or automatically, such as by computer, activates the motor 14 to rotate the spindle 12 and index the turntable 11 through ¼th of a revolution until the die assembly 15 has been positioned in the punching station II (FIG. 1).

After the die assembly 15 has been indexed into station II and the lead L has sufficiently cooled, for example to a lower temperature range of 350–450 deg. F., the shaft 60 has been rotated to a position in which the eccentric cams 62 drive down the clamp post 64 causing the clamp member 65 to descend and engage the tapered surface of the die members 16 and 17, and thereby hold the die members 16 and 17 together in a closed position.

The continued rotation of the shaft 60 causes the eccentric mechanism 58 to drive down the punch member 53 causing the punch 54 to descend coaxially between the threaded die jaws 28 and 29 and the lower integral mold cavity 21, as illustrated in FIGS. 3 and 5.

In FIG. 5, the punch 54 has forced its way through the center of the partially molten lead L in the die assembly 15 until the bottom of the punch 54 has reached the bottom of the mold cavity 21. At this point, the bottom of the punch 54 just clears the upward facing annular ledge 53 and enters the bottom open end 34 to shear off any part of the molten lead L below the punch 54 from the lead remaining within the mold cavity 21. Thus, the punch 54 completely removes a core of substantially the same size as the punch 54 from the material L within the mold or die cavity and forces the core material downward, as illustrated in FIG. 5 to form the plug 37. Simultaneously, as the punch 54 is forming the hollow interior of the matrix, it is forcing the remaining lead alloy L laterally outward into the molded surfaces on the inner walls of the mold cavity 21 and the die jaws 28 and 29. Such pressure not only makes the wall of the matrix or bushing member more dense, but also squeezes the lead material to eliminate any air pockets or porosity.

The bottom edge of the shoulder 55 on the punch member 53 is designed to cooperate with the top open end 31 of the die chamber in order to shear off any lead material, such as the waste material or ring 76, as best seen in FIGS. 5 and 6.

Continued rotation of the shaft 60 raises the punch 54 from the die cavity 21 and to its elevated position above the die assembly 15, as disclosed in FIG. 3. As the punch 54 is being retracted upward, the cam surfaces 69 are engaging the cam follower or roller 70 causing the bell-crank 71 to pivot and to positively elevate the clamp posts 64 in order to disengage and unlock the die members 16 and 17.

The turntable 11 is then indexed until the die assembly 5 is rotated to station III. In station III, an air jet 75 is actuated to blow the severed waste material or ring 76 laterally off the top of the die assembly 15, as illustrated in FIG. 6.

Then, the turntable 11 is indexed to cause the die assembly 15 to move to station IV, namely the ejector station. In station IV, the cylinders 70 are actuated to drive upward the piston 71 and the ejector die actuator 42 in order to produce two resulting actions. In one of these actions, the cam surfaces 45 on the upper ends of the die actuator 44 engage the opposing cam surfaces in the cam recess 50 on the die members 16 and 17 simultaneously causing laterally outward movement of the die members 16 and 17 to retract the threaded die jaws 28 and 29 away from the molded matrix or bushing.

The second simultaneous action includes the upward movement and engagement by the ejector boss 43 against the base 35 of the ejector member to cause the upper annular ledge 33 forming the top of the ejector base 35 to engage and force upward the bottom of the molded matrix or bushing 25, as illustrated in FIG. 8. Since the inner walls of the lower mold cavity 21 are tapered upward, the upward movement of the bushing 25 automatically causes separation between the side wall of the bushing 25 and the mold surfaces of the mold cavity, as disclosed in FIG. 8.

The bushing 25 is then removed from the upper portion of the die assembly 15 by hand, or by any other means to form the completed bushing 25 illustrated in FIG. 9.

Figure 10:
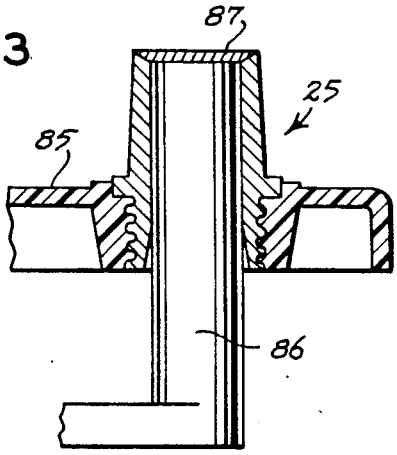
FIG. 10 is a fragmentary sectional elevation of the completed bushing installed in a battery casing and sealed to the terminal post.

The lead alloy bushing 25, free of porosity, is then ready for assembly by the battery manufacturer. The top wall or lid of the battery case is formed in a plastic state about the threaded portion of the bushing 25. When the battery lid 85 is placed over the battery case, the terminal or post 86 extends upward through the inner core of the bushing 25 and is sealed at its top edge to the top edge of the bushing 25 by a welded layer 87 (FIG. 10).

It is thus seen that a process for forming or molding a battery terminal bushing has been described which is capable of completely removing the air pockets from the metal wall of the bushing 25. Moreover, a unique apparatus has also been described which is fully capable of producing the porosity-free lead alloy bushing 25.

What is claimed is:

1. A method of forming a battery terminal bushing comprising the steps of:

(a) pouring a molten lead alloy into the cavity of a mold defining the exterior surface of a battery terminal bushing and having a central axis and top and bottom ends, (b) forcing a substantially cylindrical punch having a diameter less than the cross-sectional dimension of said exterior surface through said top open end and coaxially of said central axis to a predetermined depth through said molten lead alloy within said mold cavity and forcing a plug of said lead alloy through said open bottom end of said mold cavity, (c) withdrawing said punch from said mold cavity to form said battery terminal bushing, and (d) extracting said battery terminal bushing from said mold cavity.

2. The method according to claim 1 further comprising the step of heating a predetermined amount of lead alloy to produce said molten lead alloy before said pouring step.

3. The method according to claim 1 in which said forcing step further comprises forcing said punch through said mold cavity in which said open end is a top open end, said mold cavity further comprising an open bottom end, said punch being longer than the height between said top and bottom open ends.

4. The method according to claim 3 in which the open bottom end of said mold cavity is surrounded by an annular upward facing ledge, said forcing step comprising the step of forcing said punch down through the molten lead alloy in said mold cavity until the lower portion of said punch passes through said bottom open end within said annular ledge and simultaneously shearing the lead alloy in advance of said punch from the lead alloy remaining in said mold cavity.

5. The method according to claim 4 in which said top open end is surrounded by an annular upward directed ledge, an upper end portion of said punch terminating in an enlarged shoulder, whereby said forcing step comprises forcing said punch down through said mold cavity until said shoulder engages said upper ledge to sever any lead alloy above said upper annular ledge from any lead or alloy within said mold cavity.

6. The method according to claim 1 in which said mold comprises a pair of opposing die jaws adapted to fit together in a closed position to define a portion of said mold cavity, and further comprising the step of holding said die jaws together in said closed position during said forcing and withdrawing steps, and further comprising the step of moving said die jaws apart to an open position after said withdrawing step.

7. The method according to claim 4 in which said extracting step comprises forcing upward said annular ledge into said mold cavity to extract the formed battery terminal bushing from said mold cavity.

8. The method according to claim 7 in which said mold comprises a pair of opposed die jaws adapted to fit together in a closed position to define a portion of said mold cavity, and further comprising the step of moving said die jaws away from each other during said extracting step.

9. An apparatus for forming a battery terminal bushing comprising:

(a) a mold cavity having an interior surface defining the exterior surface of a battery terminal bushing to be formed and having open top and bottom ends and a vertical central axis, (b) means for pouring a molten lead alloy through said open top end into said mold cavity, (c) an upright punch having a substantially cylindrical surface of a diameter less than the cross-sectional dimension of said interior cavity surface and a length at least as great as the height of said mold cavity between said open top and bottom ends, (d) drive means for moving said punch coaxially downward of said mold cavity through the center of said molten lead alloy within said mold cavity and through at least said height of said mold cavity to force a plug of said lead alloy through said open bottom end of said mold cavity, (e) means for retracting said punch from said mold cavity, and (f) means for ejecting a bushing molded from said lead alloy from said mold cavity.

10. The invention according to claim 9 further comprising an upward facing, lower annular ledge surrounding said bottom open end of said mold cavity, said lower annular ledge being adapted to receive said punch and the lead alloy plug in advance of said punch, the lower end portion of said punch and said lower annular ledge cooperating to shear the lead alloy plug from the lead alloy remaining in said mold cavity.

11. The invention according to claim 9 further comprising an upward facing, upper annular ledge surrounding said top open end of said mold cavity, said punch having an upper end portion terminating in an enlarged shoulder adapted to abut against said upper annular ledge when said punch has descended entirely through the height of said mold cavity, said shoulder and said top annular ledge cooperating to shear any lead alloy above said upper ledge from any lead alloy within said mold cavity.

12. The invention according to claim 10 in which said ejecting means comprises means for forcing upward said lower annular ledge to eject a battery terminal bushing formed in said mold cavity from said mold cavity.

13. The invention according to claim 12 in which said mold cavity comprises a lower integral mold cavity and an upper pair of opposed die jaws, and means for moving said die jaws toward each other to a closed position for receiving said molten alloy and away from each other to an open position for disengaging the molded bushing.

14. The invention according to claim 13 further comprising clamp means for clamping said die jaws in said closed position while said drive means reciprocably moves said punch, and means for unclamping said die jaws before said means for moving said die jaws moves said die jaws to said open position.

15. The invention according to claim 14 in which said clamp means are adapted to be actuated to said clamping position prior to the actuation of said drive means for reciprocably moving said punch.

16. The invention according to claim 13 in which said ejecting means further comprises said means for moving said die jaws away from each other simultaneously with the upward movement of said lower annular ledge by said upward forcing means.

* * * * *